US006454611B1

(12) United States Patent
Francis

(10) Patent No.: US 6,454,611 B1
(45) **Date of Patent: *Sep. 24, 2002**

(54) SURFACE MOUNTABLE ELECTRICAL CONNECTOR SYSTEM

(75) Inventor: Dexter W. Francis, Salt Lake City, UT (US)

(73) Assignee: 3Com Corporation, Santa Clara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/949,782

(22) Filed: Sep. 10, 2001

Related U.S. Application Data

(63) Continuation of application No. 09/618,164, filed on Jul. 17, 2000, now Pat. No. 6,315,618, which is a continuation of application No. 09/417,577, filed on Oct. 14, 1999, now Pat. No. 6,146,209, which is a continuation of application No. 08/906,023, filed on Aug. 5, 1997, now Pat. No. 6,012,953.

(51) Int. Cl.[7] ..... H01R 24/00

(52) U.S. Cl. ..... 439/676; 439/344; 439/76.1; 361/686

(58) Field of Search ..... 439/676, 344, 439/76.1, 946, 946.2, 329, 928.1, 638; 361/686

(56) References Cited

U.S. PATENT DOCUMENTS

| | | | |
|---|---|---|---|
| 1,780,847 A | 11/1930 | Smith | |
| 2,445,244 A | 7/1948 | Seaver | 173/334 |
| 2,916,720 A | 12/1959 | Steans | 339/91 |
| 3,289,149 A | 11/1966 | Pawloski | 339/183 |
| 3,368,181 A | 2/1968 | Gimpel | 339/61 |
| 3,771,098 A | 11/1973 | Dempsey | 339/14 |
| 4,059,321 A | 11/1977 | Rasmussen | 339/34 |

(List continued on next page.)

FOREIGN PATENT DOCUMENTS

| | | |
|---|---|---|
| CH | 682961 | 12/1993 |
| DE | 0 355 413 | 7/1989 |
| JP | 61-256850 | 11/1986 |
| JP | 4-10748 | 1/1992 |
| JP | 58-34370 | 3/1993 |
| JP | 6-52923 | 2/1994 |
| JP | 6-61658 | 3/1994 |
| JP | 6-61659 | 3/1994 |
| WO | WO 95/13633 | 5/1995 |

OTHER PUBLICATIONS

Switching Connector, IBM Technical Disclosure Bulletin, vol. 7, No. 6, Nov. 1964.

Multi–Port Connector Adapter and Cabling for Personal Computers, IBM Technical Disclosure Bulletin, vol. 32, No. 10B, Mar. 1990.

(List continued on next page.)

*Primary Examiner*—Tho D. Ta
(74) *Attorney, Agent, or Firm*—Workman, Nydegger & Seeley

(57) ABSTRACT

A connector platform includes a base having a first end and opposing second end. A retention wall upwardly projects from the first end of the base and has a plurality of slots longitudinally extending therein. A plurality of resiliently flexible conducting wires each have a first end projecting from the first end of the base and a securing portion extending from the first end of the base to the second end thereof. Each conducting wire further includes an engaging portion upwardly projecting from the second end of the base to the retention wall. A second end of each conducting wire is freely disposed within a corresponding slot of the retention wall. The platform is selectively enclosed within the housing of an electrical apparatus. The housing defines an opening which provides access to the platform. The opening and platform combine to form a receptacle configured to receive a standard RJ-type plug.

56 Claims, 3 Drawing Sheets

U.S. PATENT DOCUMENTS

| | | | | |
|---|---|---|---|---|
| 4,186,988 | A | 2/1980 | Kobler | 339/395 |
| 4,241,974 | A | 12/1980 | Hardesty | 339/154 |
| 4,286,835 | A | 9/1981 | Adams et al. | 339/17 |
| 4,303,296 | A | 12/1981 | Spaulding | 339/122 |
| 4,352,492 | A | 10/1982 | Smith | 273/1 |
| 4,407,559 | A | 10/1983 | Meyer | 339/126 |
| 4,428,636 | A | 1/1984 | Kam et al. | 339/97 |
| 4,497,526 | A | 2/1985 | Myers | 339/17 LC |
| 4,629,266 | A | 12/1986 | Viselli | 439/344 |
| 4,648,678 | A | 3/1987 | Archer | 339/99 |
| 4,688,875 | A | 8/1987 | O'Connor | 439/676 |
| 4,710,136 | A | 12/1987 | Suzuki | 439/374 |
| 4,767,355 | A | 8/1988 | Phillipson et al. | 439/425 |
| 4,775,333 | A | 10/1988 | Grider et al. | 439/736 |
| 4,778,410 | A | 10/1988 | Tanaka | 439/676 |
| 4,802,860 | A | 2/1989 | Kikuta | 439/79 |
| 4,820,192 | A | 4/1989 | Denkmann et al. | 439/676 |
| 4,875,872 | A | 10/1989 | Tanaka | 439/344 |
| 4,878,848 | A | 11/1989 | Ingalsbe | 439/76 |
| 4,915,648 | A | 4/1990 | Takase et al. | 439/490 |
| 4,937,464 | A | 6/1990 | Nanba et al. | 307/112 |
| 5,035,641 | A | 7/1991 | Van-Santibrink et al. | 439/329 |
| 5,051,099 | A | 9/1991 | Pickles et al. | 439/108 |
| 5,064,388 | A | 11/1991 | Paladel | 439/607 |
| 5,118,311 | A | 6/1992 | Margini | 439/676 |
| 5,132,877 | A | 7/1992 | Branan et al. | 361/395 |
| 5,139,439 | A | 8/1992 | Shie | 439/359 |
| 5,183,404 | A | 2/1993 | Aldous et al. | 439/55 |
| 5,184,282 | A | 2/1993 | Kaneda et al. | 361/395 |
| 5,244,412 | A | 9/1993 | Hatch et al. | 439/567 |
| 5,299,956 | A | 4/1994 | Brownell et al. | 439/638 |
| 5,310,360 | A | 5/1994 | Peterson | 439/571 |
| 5,310,363 | A | 5/1994 | Brownell et al. | 439/676 |
| 5,336,099 | A | 8/1994 | Aldous et al. | 439/131 |
| 5,338,210 | A | 8/1994 | Beckham et al. | 439/131 |
| 5,364,294 | A | 11/1994 | Hatch et al. | 439/676 |
| 5,391,094 | A | 2/1995 | Kakinoki et al. | 49/638 |
| 5,403,207 | A | 4/1995 | Briones | 439/620 |
| 5,411,405 | A | 5/1995 | McDaniels et al. | 439/131 |
| 5,425,660 | A | 6/1995 | Weikle | 439/676 |
| 5,429,522 | A | 7/1995 | Noschese et al. | 439/133 |
| 5,431,586 | A | 7/1995 | Klas et al. | 439/676 |
| 5,457,601 | A | 10/1995 | Georgopulos et al. | 361/686 |
| 5,478,261 | A | 12/1995 | Bogese, II | 439/676 |
| 5,481,616 | A | 1/1996 | Freadman | 381/90 |
| 5,499,923 | A | 3/1996 | Archibald et al. | 439/26 |
| 5,503,572 | A | 4/1996 | White et al. | 439/676 |
| 5,505,633 | A | 4/1996 | Broadbent | 439/329 |
| 5,509,811 | A | 4/1996 | Homic | 439/55 |
| 5,538,442 | A | 7/1996 | Okada | 439/676 |
| 5,547,401 | A | 8/1996 | Aldous et al. | 439/676 |
| 5,554,037 | A | 9/1996 | Uleski | 439/76.1 |
| 5,561,727 | A | 10/1996 | Akita et al. | 385/88 |
| 5,562,504 | A | 10/1996 | Moshayedi | 439/638 |
| 5,580,274 | A | 12/1996 | Tsair | 439/571 |
| 5,608,607 | A | 3/1997 | Dittmer | 361/686 |
| 5,634,802 | A | 6/1997 | Kerklaan | 439/131 |
| 5,642,259 | A | 6/1997 | Ma | 361/686 |
| 5,660,568 | A | 8/1997 | Moshayedi | 439/654 |
| 5,667,395 | A | 9/1997 | Okada et al. | 439/131 |
| 5,674,093 | A | 10/1997 | Vaden | 439/676 |
| 5,679,013 | A | 10/1997 | Matsunaga et al. | 439/144 |
| 5,727,972 | A | 3/1998 | Aldous et al. | 439/655 |
| 5,773,332 | A | 6/1998 | Glad | 439/344 |
| 5,774,342 | A | 6/1998 | Brandenburg et al. | 361/774 |
| 5,779,503 | A | 7/1998 | Tremblay et al. | 439/676 |
| 5,791,943 | A | 8/1998 | Lo et al. | 439/676 |
| 5,797,771 | A | 8/1998 | Garside | 439/610 |
| 5,816,832 | A | 10/1998 | Aldous et al. | 439/131 |
| 5,879,199 | A | 3/1999 | Belopolsky | 439/701 |
| 5,911,602 | A | 6/1999 | Vaden | 439/676 |
| 5,984,731 | A | 11/1999 | Laity | 439/676 |
| 5,989,042 | A | 11/1999 | Johnson et al. | 439/131 |
| 6,116,962 | A | 9/2000 | Laity | 439/676 |

OTHER PUBLICATIONS

Keystone Jack, EIA/TIA 568 CAT 5, Superior Modular Products, Jul. 21, 1994 (2 pages).

UMJ Keystone Jack (exploded view), prior art photograph, date unknown.

L–Shaped Connector Block (perspective view), prior art photograph, date unknown.

L–Shaped Connector Block (side view), prior art photograph, date unknown.

Plaintiff's Exhibit 84, front perspective view, date unknown.

Plaintiff's Exhibit 84, rear perspective view, date unknown.

Plaintiff's Exhibit 84, side perspective view, date unknown.

Plantiff's Exhibit 84, cover removed, top view, date unknown.

Plantiff's Exhibit 84, cover removed, bottom view, date unknown.

P.E. Knight, et al., "Electrical Connector for Flat Flexible Cable" IBM Technical Disclosure Bulletin, vol. 25, No. 1, Jun. 1982.

SURFACE MOUNTABLE ELECTRICAL CONNECTOR SYSTEM

CROSS-REFERENCE TO RELATED APPLICATIONS

This application is a continuation application of U.S. patent application Ser. No. 09/618,164, which was filed on Jul. 17, 2000, now U.S. Pat. No. 6,315,618, which is a continuation of U.S. patent application Ser. No. 09/417,577, which was filed on Oct. 14, 1999, now U.S. Pat. No. 6,146,209, which is a continuation application of U.S. patent Ser. No. 08/906,023 which was filed on Aug. 5, 1997, now U.S. Pat. No. 6,012,953. The above-identified applications and patents are hereby incorporated by reference in its entirety.

BACKGROUND OF THE INVENTION

1. Field of the Invention

The present invention relates to telephone and data communication connectors and, more specifically to connectors for electrically coupling PC boards to communication lines.

2. Description of Related Art

Electrical connectors such as RJ-type connectors provide an easy and quick method for coupling a data or telephone line, to a telephone, modem, or computer. Due to the simplicity of the connection and the corresponding standardized structure, RJ-type connections are used extensively in the telecommunication and computer industries. RJ-type connectors include a plug, or contact block and a receptacle or socket. The plug is attached to the end of an electrical cable or wire. The RJ plug is selectively received within a receptacle or socket which is secured to the hardware.

An RJ plug or contact block comprises a small block housing a plurality of distinct metal contacts which are discretely attached to different wires. A plurality of thin slots extend from the end of the block to each of the contacts. Mounted on the outside of the block is a flexible retention arm.

In complement, the receptacle comprises an integral housing having a socket formed therein. The housing is electrically coupled to the desired hardware. The socket has a plurality of flexible wires which are oriented to be received within corresponding slots of the RJ plug when the RJ plug is slid into the socket. The wires within the housing press against corresponding contacts on the RJ plug to complete electrical connection between the RJ plug and socket.

Formed on the roof of the socket is a recess. As the RJ plug is slid into the socket, the flexible retention arm on the RJ plug is initially compressed. The flexible retention arm is biased upward to engage the recess. Engagement between the retention arm and the recess locks the RJ plug within the socket. By later selectively compressing the flexible retention arm, the plug is released from the recess and the RJ plug can be easily removed from the socket.

Although used extensively, there are several shortcomings associated with conventional receptacles used with RJ plugs to make connectors. For example, the various electronic industries are continually struggling to miniaturize hardware. Increasingly, the receptacle housing is one of the larger internal components of the improved, slimmer and trimmer hardware. This is especially true where the receptacle is being mounted on a circuit board. Accordingly, the size of the receptacle is often the limiting factor in the size or thickness of a structure.

The relatively large size of the receptacle can also take up critical space on circuit boards which, under conventional standards, may be limited as to size. Furthermore, the large size of the receptacle can make it difficult to pick and place the receptacle on a circuit board using conventional equipment. This is because most equipment for picking and placing on a circuit board are designed for handling only very small components. As a result, the receptacle may have to be positioned manually.

An additional problem with conventional receptacles for RJ connectors is that the receptacle functions as both the structure for making the electrical contact and for mechanically securing the RJ plug to the hardware. It is a common occurrence that the wire attached to the RJ connector is pulled or tripped over, producing significant stress on the receptacle housing. To prevent the receptacle housing from breaking and to prevent the receptacle from being pulled out or displaced within the hardware, thereby severing the electrical connection, the receptacle must be structurally reinforced. In turn, this structural reinforcing increases the size of the receptacle, thereby further complicating the problems discussed above.

OBJECTS AND BRIEF SUMMARY OF THE INVENTION

Accordingly, it is an object of the present invention to provide improved apparatus for electrically coupling plugs to hardware.

Another object of the present invention is to provide improved apparatus for connectors where the receptacle is smaller than conventional receptacles.

Yet another object of the present invention is to provide improved connectors where the connector has a shorter height than conventional receptacles.

Yet another object of the present invention is to provide improved connectors where the connectors use less surface area on a circuit board than conventional receptacles.

Finally, it is an object of the present invention to provide improved connectors which reduce the mechanical stress placed on the electrical connection.

To achieve the foregoing objects, and in accordance with the invention as embodied and broadly described herein in the preferred embodiment, a surface mountable connector is provided. The plug includes a block having a first end and an opposing second end. A retention wall projects upwardly from the first end of the base and has a plurality of slots longitudinally extending therethrough. A plurality of resiliently flexible conducting wires each have a first end projecting from the first end of the base and a securing portion extending from the first end of the base to the second end thereof Each conducting wire further includes an engaging portion upwardly projecting from the second end of the base to the retention wall. A second end of each conducting wire is freely disposed within a corresponding slot in the retention wall.

During use, a typical receptacle is attached to an electronic component. For example, the receptacle can be surface mounted on a circuit board with the first end of each of the conducting wires soldered or otherwise connected to leads on the circuit board. The receptacle and circuit board are next enclosed within the housing of the electrical device, such as a telephone, computer, or modem. The housing of the electrical device must include an opening to facilitate access by a plug to the receptacle. The opening is defined by a perimeter wall that is configured substantially complementary to the plug. When the plug passes through the opening and engages the receptacle, the discrete contacts on the receptacle are biased against a corresponding conducting wire on the plug. The receptacle captures the biased retaining arm on the plug. The plug and receptacle combine to form the connector.

In contradistinction, the inventive connector utilizes a conventional plug, but removes some of the receptacle structures to reduce the overall size of the connector. The removed structures are replaced by structures incorporated in the housing of the electrical device itself Some of the receptacle functions in the inventive connector are incorporated into the opening in the housing of the device. When the plug passes through the opening, contact wires in a contact platform make electrical connection with corresponding wires on the plug. The walls of the opening itself have ridges designed to capture and engage the biased retaining arm of the plug. Thus, the plug and the walls of the opening in the housing of the device form the physical connection without the need for a separate receptacle. The contact platform facilitates the electrical connection. Only the contact platform is attached to the PC board. The contact platform, housing opening and plug make up the components of the inventive connector system.

The inventive connector system including the uniquely configured housing provide several advantages over conventional connectors. For example, since the inventive connector utilizes an opening in the housing, the portions of the receptacle such as the walls and roof are not required. The connector system may now have a smaller height, width, and surface area compared to conventional receptacles. This allows for further miniaturizing of structures in which any type of connection is desired. By minimizing the size of the receptacle, the connector can be easily surface mounted on a circuit board using conventional pick and place equipment. Finally, since the receptacle is limited solely to the function of providing electrical contact and does not perform the function mechanical engagement with the plug, the stresses produced are shifted to the device housing.

These and other objects, features, and advantages of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
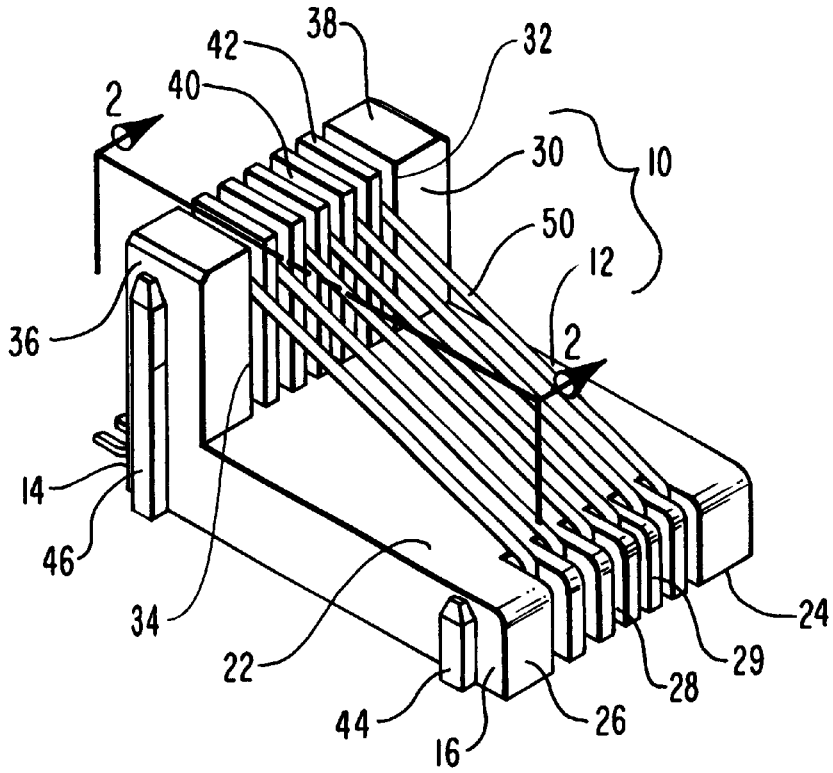
FIG. 1 is a perspective view of one embodiment of the contact platform.

Depicted in FIG. 1 is one embodiment of a platform 10 incorporating features of the present invention. As depicted therein, platform 10 comprises a substantially rectangular base 12 having a first end 14, an opposing second end 16. Second end 16 of base 12 terminates at an end face 26. A plurality of slots 28 are recessed within end face 26 and define a plurality of spaced apart insulating ribs 29. Base 12 further includes a top surface 22 and an opposing bottom surface 24.

Upstanding from first end 14 on top surface 22 of base 12 is a substantially rectangular retention wall 30. Retention wall 30 has opposing sidewalls 32 and 34 which extend from base 12 to atop end 36. Top end 36 of retention wall 30 terminates at a top face 38. A plurality of parallel slots 40 extend through retention wall 30 from top face 38 to base 12. Slots 40 define a plurality of parallel, spaced apart separating ribs 42.

Figure 2:
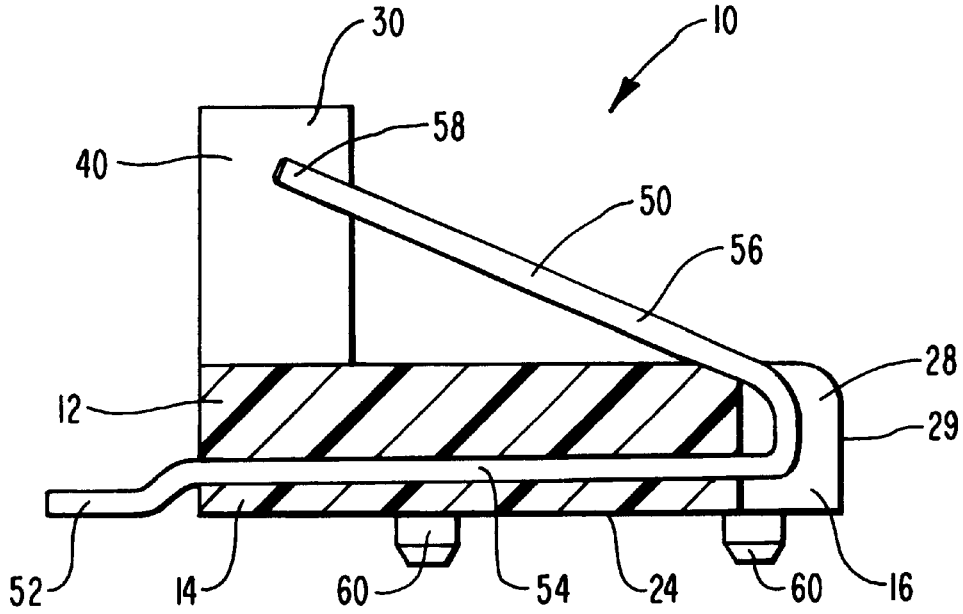
FIG. 2 is a cross-sectional side view of the platform shown in FIG. 1 taken along section lines 2—2.

An alignment ridge 44 projects from second end 16 of base 12. Alignment ridges 44 project in substantial parallel alignment with retention wall 30. Similarly, an alignment ridge 46 projects from first end 14 of base 12. Alignment ridges 46 also upwardly extend so as to likewise project from retention wall 30. Alignment ridges 46 are also oriented substantially parallel with retention wall 30. As depicted in FIG. 2, a pair of alignment pegs 60 project from bottom surface 24 of base 12.

Platform 10 further includes a plurality of discrete conducting wires 50. As depicted in FIG. 2, each conducting wire 50 includes a first end 52 freely projecting from first end 14 of base 12. An adjacent securing portion 54 of conducting wire 50 extends from first end 14 of base 12 to second end 16 thereof Specifically, securing portion 54 terminates within a corresponding slot 28 positioned at second end 16 of base 12. Conducting wire 50 further includes an engaging portion 56 extending from second end 16 of base 12 back to retention wall 30. Conducting wire 50 terminates at a second end 58 that is freely disposed within a corresponding slot 40 of retention wall 30. Engaging portion 56 of conducting wire 50 projects at an upward angle such that second end 58 is elevated above base 12.

In the described configuration, insulating ribs 29 keep the plurality of conducting wires 50 separated to prevent accidental shorting therebetween. Separating ribs 42 perform a similar function of keeping second end 58 of each conducting wire 50 separated and insulated. As discussed later, separating ribs 42 also act as guides during movement of second end 58 of each conducting wire 50.

Base 12 and retention wall 30 are preferably integrally molded from an insulating material, such as polycarbonate plastic, using conventional injection molding processes. Securing portion 54 of conducting wires 50 can be enclosed within base 12 during the molding process. Alternatively, small passageways can be longitudinally formed through base 12. Securing portion 54 can then be slid within a corresponding passageway and secured therein, such as with an adhesive.

Each conducting wire 50 is preferably formed of a resiliently flexible metal such as spring steel. Accordingly, as a downward force is applied to engaging portion 56, engaging portion 56 produces a biasing force back toward its original position.

Platform 10 is used for electronic coupling with a plug, such as an RJ-type plug. As used in the specification and appended claims, the term "plug" is intended to include all types and styles of connectors including RJ-type and other connectors for physical electrical connection of communication devices. By way of example and not by limitation, various types of RJ connectors which could be used for coupling with platform 10 include the "RJ-11" and "RJ-45." Platform 10, as depicted in FIGS. 1 and 2, is merely one embodiment of the invention. Platform 10 can of course vary to accommodate different types of RJ connectors. Different RJ connectors may require platform 10 to have a different number, sizing, and spacing of conducting wires 50 along with other modifications. The necessary modifications to platform 10 to enable coupling to different connectors would be known to those skilled in the art based on the disclosure herein.

Platform 10 can be used with any electrical equipment in which it is desirable to couple an RJ connector. By way of example and not limitation, conventional types of equipment which can use platform 10 include telephones, answering machines, personal computers, network systems, and modems.

Figure 3:
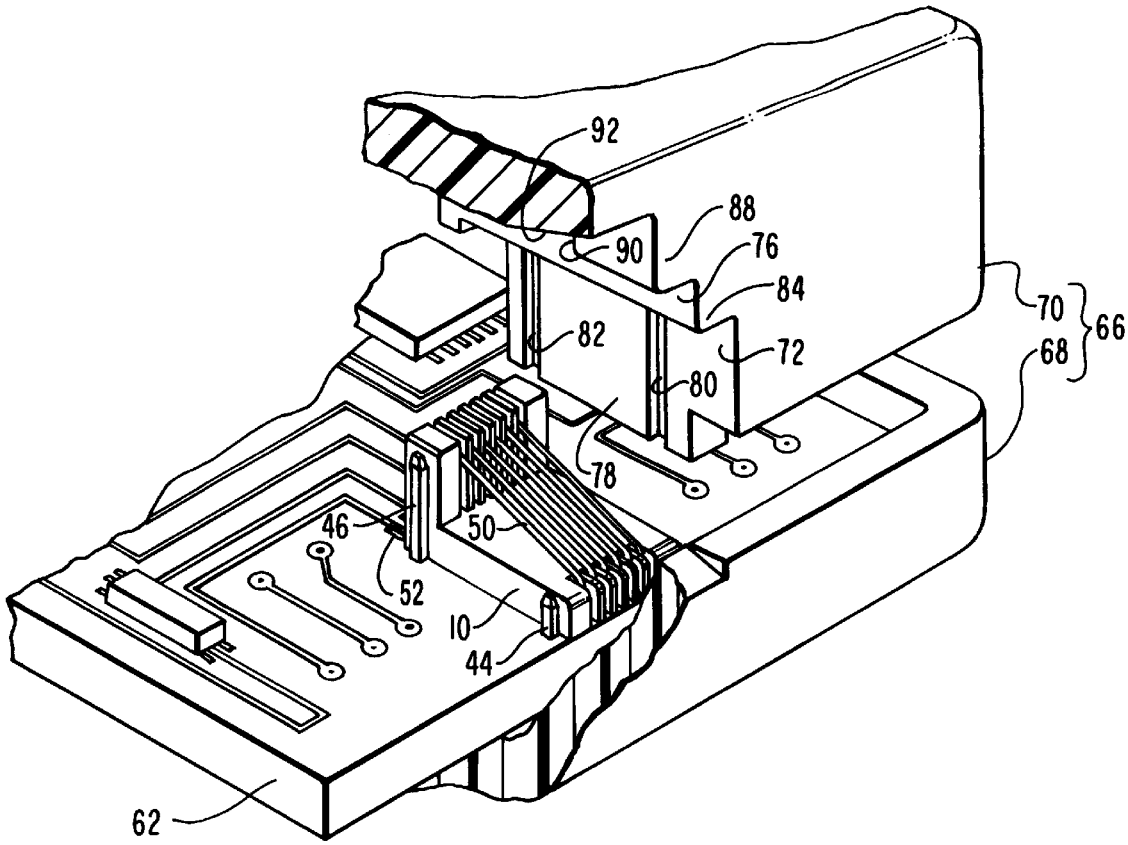
FIG. 3 is a perspective view of the platform shown in FIG. 1 mounted on a circuit board and enclosed within a housing.
Figure 4:
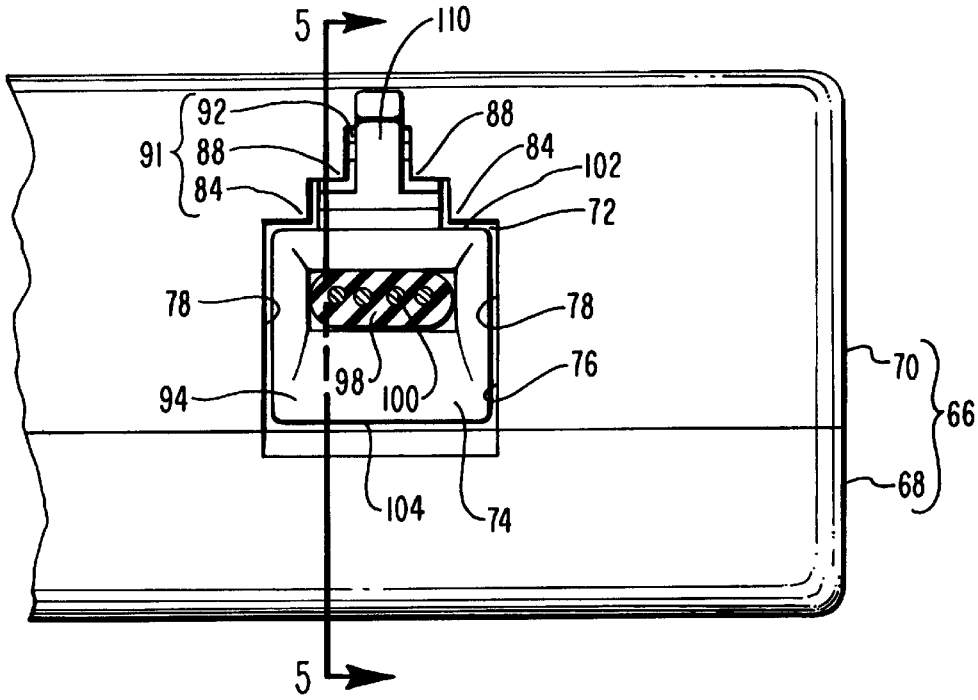
FIG. 4 is an elevated end view of an opening in the housing shown in FIG. 3 with an RJ plug received therein.
Figure 5:
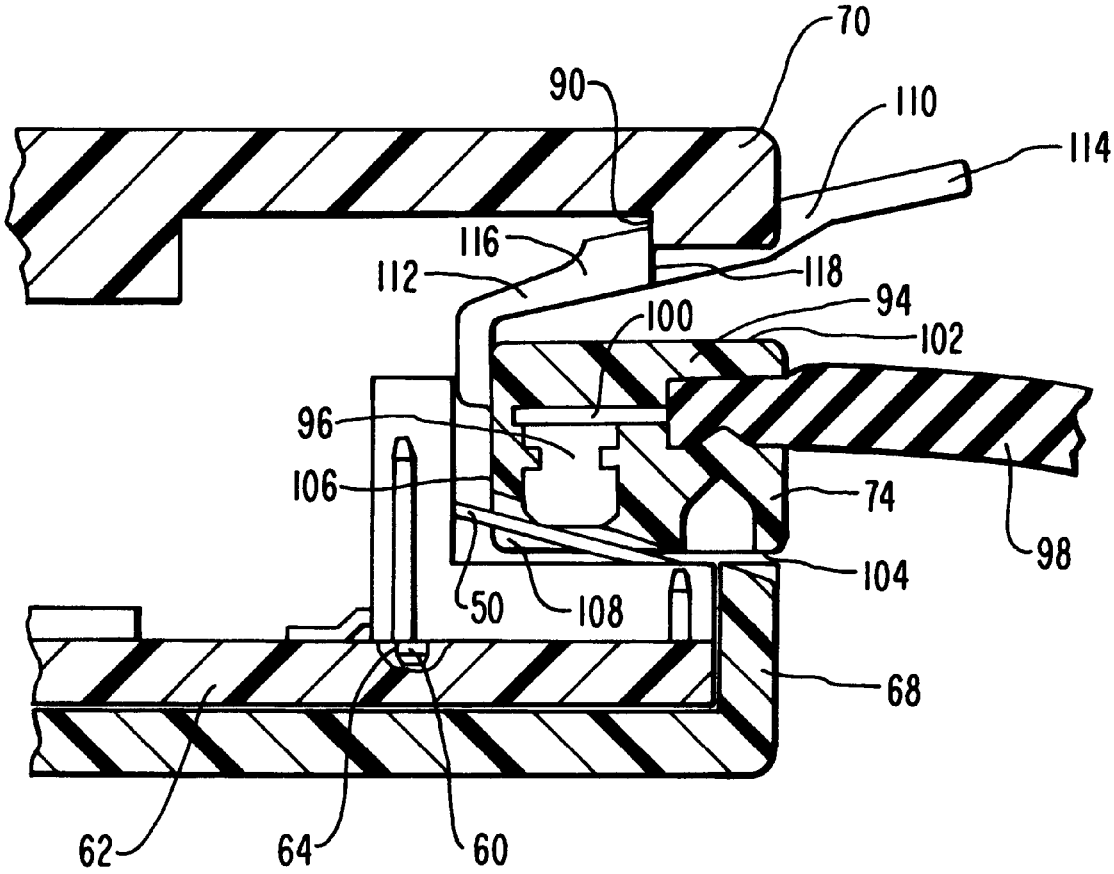
FIG. 5 is a cross-sectional side view of the components making the connector received within the opening of the housing shown in FIG. 4 taken along section lines 5—5.

By way of example as to how platform 10 is assembled with an electrical apparatus, depicted in FIGS. 3–4 platform 10 is surface mounted onto a circuit board 62. As depicted in FIG. 5, circuit board 62 includes apertures 64 which are configured to receive a corresponding alignment pin 60 so that platform 10 is properly positioned on circuit board 62. Returning to FIG. 3, in this position, first end 52 of each conducting wire 50 is soldered or otherwise connected to an appropriate lead on circuit board 62.

With platform 10 electrically coupled with circuit board 62, circuit board 62 and platform 10 are substantially enclosed within a housing 66. Housing 66 which, for example, could comprise the outside housing of a telephone, personal computer or other device, is depicted as comprising a base cover 68 and a top cover 70. Circuit board 62 and platform 10 are sandwiched between top cover 70 and base cover 68.

As depicted in FIGS. 3–4, the combined top cover 70 and base cover 68 form an opening 72 extending from the exterior to platform 10. Opening 72 enables a plug 74 to selectively attach with platform 10. Opening 72 is bounded by a perimeter wall 76 that is designed to receive plug 74 in proper alignment. Perimeter wall 76 in conjunction with platform 10 form a structure which is analogous to an RJ socket or receptacle. Perimeter wall 76 includes opposing sidewalls 78 each having a longitudinal first groove 80 configured to receive a corresponding alignment ridge 44 on base 12 and a longitudinal second groove 82 configured to receive a corresponding alignment ridge 46.

The inserting of alignment ridges 44 and 46 within corresponding grooves 80 and 82 facilitate proper positioning of RJ coupler 10 relative to housing 66 and helps to securely hold platform 10 between opposing sidewalls 78. Inwardly projecting from the top end of each sidewall 78 are opposing first ridges 84. Each first ridge 84 extends back to retention wall 30. Inwardly projecting above each first ridge 84 is a corresponding second ridge 88. Each second ridge 88 terminates at an end face 90 positioned only part way back toward retention wall 30. Extending between and above each second ridge 88 is a ceiling 92. First ridges 84, second ridges 88, and ceiling 92 combine to from a roof 91 extending between sidewalls 78.

As depicted in FIGS. 4 and 5, plug 74 comprises a contact block 94 housing a plurality of discrete metal contacts 96. A cable 98 is attached to contact block 94 and includes a plurality of discrete wires 100. Each wire 100 is connected to a corresponding contact 96. Contact block 94 includes a top surface 102, a bottom surface 104, and a front face 106. A plurality of sloped access slots 108 extend between front 106 and bottom surface 104 so as to openly expose a portion of each contact 96.

Projecting above contact block 94 is a flexible biased retention arm 110. Arm 110 includes a distal end 112 attached to contact block 94 and an opposing free proximal end 114. Radially projecting out from each side of arm 110 at distal end 112 are locking ramps 116. Each locking ramp 116 terminates at a face 118 projecting towards proximal end 114.

During use, plug 74 is selectively slid within opening 72 such that each contact wire 50 is received within a corresponding access slot 108 so as to bias against a discrete contact 96. This advancement of plug 74 causes each contact 96 to push down against engagement portion 56 of a corresponding conducting wire 50 so as to produce a continuous contact therebetween.

As plug 74 is inserted in to opening 72, retention arm 110 is initially pressed towards contact block 94 as locking ramps 116 pass under second ridges 88. After ramps 116 pass over second ridge 88, retention arm 110 extends up to selectively lock within opening 72. Face 118 of locking arm 110 is biased against end face 90 of second ridge 88. Removal of plug 74 is facilitated by merely depressing proximal end 114 of arm 110 and pulling plug 74 from opening 72.

The present invention also includes means for mechanically, releasably securing plug 74 within opening 72 in housing 66. By way of example and not by limitation, the means include second ridges 88 each having an end face 90 that locks against arm 110 as discussed above.

It will be appreciated that by obviating the need for a complete receptacle structure, some space savings may be enjoyed. The need for structures corresponding to side walls has been removed thereby allowing a smaller footprint. Likewise, the need for a roof on the receptacle itself has been eliminated thereby allowing for a thinner card. The only remaining vertical structure, the retention wall, does not need to project upwardly from the base a distance greater than necessary to halt the forward progress of the plug. The retention wall may also be narrower than depicted to allow other components to take the space. Similarly, it will be appreciated that the retention wall may actually be replaced with a similar structure belonging to another component on the PC board. Such integration of function is in keeping with the spirit of this invention.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A modem that allows communication to be established with a data or telephone line, the modem comprising:

a housing;

an opening formed in the housing that is sized and configured to receive a RJ-type connector plug, the opening including one or more surfaces formed by the housing that are adapted to contact the RJ-type connector plug when the connector plug is received within the opening, the opening providing for the physical connection of the connector plug to the housing;

a circuit board disposed within the housing, the circuit board including electronic components and circuitry that act upon a signal from the data or telephone line;

a sideless connector block having a retention wall disposed proximate the circuit board and is generally aligned with the opening in the housing; and one or more conducting wires connected to the sideless connector block which allow electrical communication to be established with the RJ-type connector plug when the connector plug is received within the opening.

2. The modem as in claim 1, wherein the conducting wires and connector block allow electrical communication to be established between the circuit board and the RJ-type connector plug when the connector plug is received within the opening.

3. The modem as in claim 1, wherein the opening formed by the one or more surfaces of the housing includes a receiving portion that is sized and configured to capture and engage a biased retention arm of the RJ-type connector plug when the connector plug is inserted into the opening.

4. The modem as in claim 1, wherein the connector block is held in a generally fixed position relative to the circuit board.

5. The modem as in claim 1, wherein the connector block includes a base.

6. The modem as in claim 1, wherein the connector block is sized and configured to limit the insertion of the RJ-type connector plug into the opening in the housing.

7. The modem as in claim 1, wherein the connector block further includes a first portion that is connected to the circuit board proximate the opening and a second portion that extends from the first portion and is sized and configured to fit within the housing.

8. A modem that allows communication to be established with a data or telephone line, the modem comprising:

a housing;

an opening formed in the housing that is sized and configured to receive a RJ-type connector plug, the opening including one or more surfaces formed by the housing that are adapted to contact the RJ-type connector plug when the connector plug is received within the opening, the opening providing for the physical connection of the connector plug to the housing;

a circuit board disposed within the housing, the circuit board including electronic components and circuitry that act upon a signal from the data or telephone line;

a substantially sideless connector block disposed proximate the circuit board and is generally aligned with the opening in the housing; and one or more conducting wires connected to the sideless connector block which allow electrical communication to be established with the RJ-type connector plug when the connector plug is received within the opening.

9. The modem as in claim 8, wherein the conducting wires and connector block allow electrical communication to be established between the circuit board and the RJ-type connector plug when the connector plug is received within the opening.

10. The modem as in claim 8, wherein the opening formed by the one or more surfaces of the housing includes a receiving portion that is sized and configured to capture and engage a biased retention arm of the RJ-type connector plug when the connector plug is inserted into the opening.

11. The modem as in claim 8, wherein the connector block is held in a generally fixed position relative to the circuit board.

12. The modem as in claim 8, wherein the connector block includes a base and a retention wall.

13. The modem as in claim 8, wherein the connector block is sized and configured to limit the insertion of the RJ-type connector plug into the opening in the housing.

14. The modem as in claim 8, wherein the connector block further includes a first portion that is connected to the circuit board proximate the opening and a second portion that extends from the first portion and is sized and configured to fit within the housing.

15. A computer that is capable of processing a signal received from a data or telephone line, the computer comprising:

a housing;

an opening formed in the housing that is sized and configured to receive a RJ-type connector plug, the opening including one or more surfaces formed by the housing that are adapted to contact the RJ-type connector plug when the connector plug is received within the opening, the opening providing for the physical connection of the connector plug to the housing;

a circuit board disposed within the housing, the circuit board including electronic components and circuitry that act upon the signal from the data or telephone line;

a sideless connector block having a retention wall disposed proximate the circuit board and which is generally aligned with the opening in the housing; and one or more conducting wires connected to the sideless connector block which allow electrical communication to be established with the RJ-type connector plug when the connector plug is received within the opening.

16. The computer as in claim 15, wherein the conducting wires and connector block allow electrical communication to be established between the circuit board and the RJ-type connector plug when the connector plug is received within the opening.

17. The computer as in claim 15, wherein the opening formed by the one or more surfaces of the housing includes a receiving portion that is sized and configured to capture and engage a biased retention arm of the RJ-type connector plug when the connector plug is inserted into the opening.

18. The computer as in claim 15, wherein the connector block is held in a generally fixed position relative to the circuit board.

19. The computer as in claim 15, wherein the connector block includes a base.

20. The computer as in claim 15, wherein the connector block is sized and configured to limit the insertion of the RJ-type connector plug into the opening in the housing.

21. The computer as in claim 15, wherein the connector block further includes a first portion that is connected to the circuit board proximate the opening and a second portion that extends from the first portion and is sized and configured to fit within the housing.

22. A computer that is capable of processing a signal received from a data or telephone line, the computer comprising:

a housing;

an opening formed in the housing that is sized and configured to receive a RJ-type connector plug, the opening including one or more surfaces formed by the housing that are adapted to contact the RJ-type connector plug when the connector plug is received within the opening, the opening providing for the physical connection of the connector plug to the housing;

a circuit board disposed within the housing, the circuit board including electronic components and circuitry that act upon the signal from the data or telephone line;

a substantially sideless connector block disposed proximate the circuit board and is generally aligned with the opening in the housing; and one or more conducting wires connected to the sideless connector block which allow electrical communication to be established with the RJ-type connector plug when the connector plug is received within the opening.

23. The computer as in claim 22, wherein the conducting wires and connector block allow electrical communication to be established between the circuit board and the RJ-type connector plug when the connector plug is received within the opening.

24. The computer as in claim 22, wherein the opening formed by the one or more surfaces of the housing includes a receiving portion that is sized and configured to capture and engage a biased retention arm of the RJ-type connector plug when the connector plug is inserted into the opening.

25. The computer as in claim 22, wherein the connector block is held in a generally fixed position relative to the circuit board.

26. The computer as in claim 22, wherein the connector block includes a base and a retention wall.

27. The computer as in claim 22, wherein the connector block is sized and configured to limit the insertion of the RJ-type connector plug into the opening in the housing.

28. The computer as in claim 22, wherein the connector block further includes a first portion that is connected to the circuit board proximate the opening and a second portion that extends from the first portion and is sized and configured to fit within the housing.

29. A personal computer that is capable of being connected to a data or telephone line, the personal computer comprising:

a housing;

an opening formed in the housing that is sized and configured to receive a RJ-type connector plug, the opening including one or more surfaces formed by the housing that are adapted to contact the RJ-type connector plug when the connector plug is received within the opening, the opening providing for the physical connection of the connector plug to the housing;

a circuit board disposed within the housing, the circuit board including electronic components and circuitry that act upon a signal from the data or telephone line;

a sideless connector block having a retention wall disposed proximate the circuit board and is generally aligned with the opening in the housing; and one or more conducting wires connected to the sideless connector block which allow electrical communication to be established with the RJ-type connector plug when the connector plug is received within the opening.

30. The personal computer as in claim 29, wherein the conducting wires and connector block allow electrical communication to be established between the circuit board and the RJ-type connector plug when the connector plug is received within the opening.

31. The personal computer as in claim 29, wherein the opening formed by the one or more surfaces of the housing includes a receiving portion that is sized and configured to capture and engage a biased retention arm of the RJ-type connector plug when the connector plug is inserted into the opening.

32. The personal computer as in claim 29, wherein the connector block is held in a generally fixed position relative to the circuit board.

33. The personal computer as in claim 29, wherein the connector block includes a base.

34. The personal computer as in claim 29, wherein the connector block is sized and configured to limit the insertion of the RJ-type connector plug into the opening in the housing.

35. The personal computer as in claim 29, wherein the connector block further includes a first portion that is connected to the circuit board proximate the opening and a second portion that extends from the first portion and is sized and configured to fit within the housing.

36. A personal computer that is capable of being connected to a data or telephone line, the personal computer comprising:

a housing;

an opening formed in the housing that is sized and configured to receive a RJ-type connector plug, the opening including one or more surfaces formed by the housing that are adapted to contact the RJ-type connector plug when the connector plug is received within the opening, the opening providing for the physical connection of the connector plug to the housing;

a circuit board disposed within the housing, the circuit board including electronic components and circuitry that act upon a signal from the data or telephone line;

a substantially sideless connector block disposed proximate the circuit board and is generally aligned with the opening in the housing; and one or more conducting wires connected to the sideless connector block which allow electrical communication to be established with the RJ-type connector plug when the connector plug is received within the opening.

37. The personal computer as in claim 36, wherein the conducting wires and connector block allow electrical communication to be established between the circuit board and the RJ-type connector plug when the connector plug is received within the opening.

38. The personal computer as in claim 36, wherein the opening formed by the one or more surfaces of the housing includes a receiving portion that is sized and configured to capture and engage a biased retention arm of the RJ-type connector plug when the connector plug is inserted into the opening.

39. The personal computer as in claim 36, wherein the connector block is held in a generally fixed position relative to the circuit board.

40. The personal computer as in claim 36, wherein the connector block includes a base and a retention wall.

41. The personal computer as in claim 36, wherein the connector block is sized and configured to limit the insertion of the RJ-type connector plug into the opening in the housing.

42. The personal computer as in claim 36, wherein the connector block further includes a first portion that is connected to the circuit board proximate the opening and a second portion that extends from the first portion and is sized and configured to fit within the housing.

43. A network system that allows an electronic device to be connected to a network, the network system comprising:

a housing;

an opening formed in the housing that is sized and configured to receive a RJ-type connector plug, the opening including one or more surfaces formed by the housing that are adapted to contact the RJ-type connector plug when the connector plug is received within the opening, the opening providing for the physical connection of the connector plug to the housing;

a circuit board disposed within the housing, the circuit board including electronic components and circuitry that act upon a signal from the network;

a sideless connector block having a retention wall disposed proximate the circuit board and is generally aligned with the opening in the housing; and one or more conducting wires connected to the sideless connector block which allow electrical communication to be established with the RJ-type connector plug when the connector plug is received within the opening.

44. The network system as in claim 43, wherein the conducting wires and connector block allow electrical communication to be established between the circuit board and the RJ-type connector plug when the connector plug is received within the opening.

45. The network system as in claim 43, wherein the opening formed by the one or more surfaces of the housing includes a receiving portion that is sized and configured to capture and engage a biased retention arm of the RJ-type connector plug when the connector plug is inserted into the opening.

46. The network system as in claim 43, wherein the connector block is held in a generally fixed position relative to the circuit board.

47. The network system as in claim 43, wherein the connector block includes a base.

48. The network system as in claim 43, wherein the connector block is sized and configured to limit the insertion of the RJ-type connector plug into the opening in the housing.

49. The network system as in claim 43, wherein the connector block further includes a first portion that is connected to the circuit board proximate the opening and a second portion that extends from the first portion and is sized and configured to fit within the housing.

50. A network system that allows an electronic device to be connected to a network, the network system comprising:

a housing;

an opening formed in the housing that is sized and configured to receive a RJ-type connector plug, the opening including one or more surfaces formed by the housing that are adapted to contact the RJ-type connector plug when the connector plug is received within the opening, the opening providing for the physical connection of the connector plug to the housing;

a circuit board disposed within the housing, the circuit board including electronic components and circuitry that act upon a signal from the network;

a substantially sideless connector block disposed proximate the circuit board and is generally aligned with the opening in the housing; and one or more conducting wires connected to the sideless connector block which allow electrical communication to be established with the RJ-type connector plug when the connector plug is received within the opening.

51. The network system as in claim 50, wherein the conducting wires and connector block allow electrical communication to be established between the circuit board and the RJ-type connector plug when the connector plug is received within the opening.

52. The network system as in claim 50, wherein the opening formed by the one or more surfaces of the housing includes a receiving portion that is sized and configured to capture and engage a biased retention arm of the RJ-type connector plug when the connector plug is inserted into the opening.

53. The network system as in claim 50, wherein the connector block is held in a generally fixed position relative to the circuit board.

54. The network system as in claim 50, wherein the connector block includes a base and a retention wall.

55. The network system as in claim 50, wherein the connector block is sized and configured to limit the insertion of the RJ-type connector plug into the opening in the housing.

56. The network system as in claim 50, wherein the connector block further includes a first portion that is connected to the circuit board proximate the opening and a second portion that extends from the first portion and is sized and configured to fit within the housing.

* * * * *